US006801725B2

(12) United States Patent
Ueda et al.

(10) Patent No.: US 6,801,725 B2
(45) Date of Patent: Oct. 5, 2004

(54) IMAGE FORMING APPARATUS

(75) Inventors: Tadayuki Ueda, Tokyo (JP); Toshihiro Motoi, Tokyo (JP); Satoshi Ogata, Tokyo (JP); Ryuji Okutomi, Tokyo (JP); Shinobu Kishi, Tokyo (JP); Eiji Nishikawa, Tokyo (JP); Kenji Izumiya, Tokyo (JP); Yumiko Higashi, Tokyo (JP); Hiroyuki Maruyama, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/434,132

(22) Filed: May 8, 2003

(65) Prior Publication Data

US 2003/0215250 A1 Nov. 20, 2003

(30) Foreign Application Priority Data

May 15, 2002 (JP) ..... 2002-140198

(51) Int. Cl.[7] ..... G03G 15/00

(52) U.S. Cl. ..... 399/38; 399/66; 399/302; 399/308

(58) Field of Search ..... 399/38, 297, 298, 399/302, 308

(56) References Cited

U.S. PATENT DOCUMENTS 6,336,025 B1 * 1/2002 Saeki ..... 399/301
6,724,410 B2 * 4/2004 Arai ..... 347/115

* cited by examiner

*Primary Examiner*—Hoan Tran
(74) *Attorney, Agent, or Firm*—Cohen, Pontani, Lieberman & Pavane

(57) ABSTRACT

An image forming apparatus includes: a photosensitive member; an intermediate transferring member to which an image formed on the photosensitive member is transferred; a press/release operation controlling section for controlling a pressing of the intermediate transferring member to the photosensitive member and for controlling a release of the pressing; a rotational actuation controlling section for controlling a rotational actuation of the photosensitive member; a judging section for judging a finish of a pressing operation carried out by the press/release operation controlling section; and a start timing controlling section for starting a control for the rotational actuation of the photosensitive member when the judging section judges the finish of the pressing operation by the rotational actuation controlling section.

9 Claims, 7 Drawing Sheets

IMAGE FORMING APPARATUS

BACKGROUND OF THE INVENTION

1. Field of the Invention

The present invention relates to an image forming apparatus comprising an intermediate transferring member to which an image is transferred by contacting it to a photosensitive member.

2. Description of Related Art

A copy machine, a printer or the like, which uses an electrophotographic system has been known. That is, after a latent image is formed on a uniformly charged photosensitive drum (photosensitive member) by a laser, an LED or the like, the image is developed by attracting a toner to the photosensitive drum. A document data is printed by transferring the image to a transfer medium, such as a paper and by fixing the toner.

In the above-described image forming apparatus, the image forming apparatus for forming an image by transferring the image to a transfer medium, such as a paper, after the toner for developing the image is intermediately transferred to the intermediate transferring member, such as an intermediate transferring belt or the like, controls the rotational actuation of the photosensitive drum in consideration of the vibration of the photosensitive drum, which is caused by the disturbance of a mechanical motion.

When the toner for developing the image on the photosensitive drum is intermediately transferred to the intermediate transferring belt, the intermediate transferring belt is pressed to the photosensitive drum. However, when the disturbance is caused by pressing the intermediate transferring belt, the photosensitive drum is more vibrated as compared with the other disturbances. Therefore, it was required to widely design the control system for the rotational actuation of the photosensitive drum by assuming the disturbance during the pressing of the intermediate transferring belt. In order to solve the problem, the rotational actuation is controlled by using a high speed operation unit, such as a DSP (Digital Signal Processor). In general, such a high speed operation unit is expensive.

If there is no disturbance caused during the pressing of the intermediate transferring belt, the range of the whole disturbance can be limited. Further, it is possible to carry out the rotational actuating control for the photosensitive drum in detail.

SUMMARY OF THE INVENTION

In order to solve the above-described problems, an object of the present invention is to realize the stability of the rotational actuating control for the photosensitive drum at a low cost.

That is, in accordance with the first aspect of the present invention, an image forming apparatus comprises:

a photosensitive member;

an intermediate transferring member to which an image formed on the photosensitive member is transferred;

a press/release operation controlling section for controlling a pressing of the intermediate transferring member to the photosensitive member and for controlling a release of the pressing;

a rotational actuation controlling section for controlling a rotational actuation of the photosensitive member;

a judging section for judging a finish of a pressing operation carried out by the press/release operation controlling section; and a start timing controlling section for starting a control for the rotational actuation of the photosensitive member by the rotational actuation controlling section when the judging section judges the finish of the pressing operation.

According to the present invention, because the rotational actuation control for the photosensitive member is started after the pressing operation of the intermediate transferring member to the photosensitive member is finished, it is not required that the vibration caused by pressing the intermediate transferring member to the photosensitive member should be considered when the rotational actuation control is carried out for the photosensitive member. Thereby, it is possible to improve the stability of the rotational actuation control for the photosensitive member.

The image forming apparatus may further comprise: a time measuring section for measuring an elapsed time from a start of an image forming process;

wherein the judging section judges whether the pressing operation of the intermediate transferring member is finished in accordance with the elapsed time measured by the time measuring section.

According to the present invention, the required time for finishing the pressing operation of the intermediate transferring member from the start of the image forming process is previously set to judge whether the required time elapses from the input of the start command for the image forming process. Therefore, it is possible to judge whether the pressing operation of the intermediate transferring member is finished and to determine the start timing of the rotational actuation control for the photosensitive member.

The image forming apparatus may comprise: a stop timing controlling section for stopping the control carried out by the rotational actuation controlling section, when a releasing operation of the intermediate transferring member is started by the press/release operation controlling section.

According to the present invention, it is possible to stop the rotational actuation control for the photosensitive member when the releasing operation of the intermediate transferring member is started. Therefore, when the rotational actuation control for the photosensitive member is carried out, it is not required that the vibration of the photosensitive member, which is caused by releasing the intermediate transferring member from the photosensitive member, should be considered when the rotational actuation control is carried out for the photosensitive member. It is possible to improve the stability of the control.

The rotational actuation controlling section may control the rotational actuation of the photosensitive member by using a feed back control and a feed forward control.

The feed back control and the feed forward control may be designed in accordance with a transmitting property of a vibration of the intermediate transferring member, the vibration being caused during the pressing.

In accordance with the second aspect of the present invention, an image forming apparatus comprises:

a photosensitive member;

an intermediate transferring member to which an image formed on the photosensitive member is transferred;

a press/release operation controlling section for controlling a pressing of the intermediate transferring member to the photosensitive member and for controlling a release of the pressing;

a rotational actuation controlling section for controlling a rotational actuation of the photosensitive member;

a judging section for judging a finish of a pressing operation carried out by the press/release operation controlling section; and a start timing controlling section for starting a control for the rotational actuation of the photosensitive member by the rotational actuation controlling section;

wherein the rotational actuation controlling section controls the rotational actuation of the photosensitive member by using the feed back control and the feed forward control; and wherein the start timing controlling section starts the feed forward control when the judging section judges that the pressing operation is finished.

According to the present invention, for example, when the image forming process is started, the control for the rotational actuation is started in accordance with the feed back control. Further, when the pressing operation is finished, the feed forward control is started. Therefore, it is possible to carry out the feed back control for the rotational actuation of the photosensitive member in consideration of the vibration caused by pressing the intermediate transferring member to the photosensitive member. Therefore, for example, it is possible to apply the image forming apparatus to the case that the required time for judging the finish of the pressing operation from the pressing of the intermediate transferring belt to the photosensitive member is limited.

The image forming apparatus may further comprise: a time measuring section for measuring an elapsed time from a start of an image forming process;

wherein the judging section judges whether the pressing operation of the intermediate transferring member is finished in accordance with the elapsed time measured by the time measuring section.

The image forming apparatus may further comprise: a stop timing controlling section for stopping the control carried out by the rotational actuation controlling section, when a releasing operation of the intermediate transferring member is started by the press/release operation controlling section.

The feed back control may be designed in accordance with a first transmitting property of a first vibration of the intermediate transferring member and a second transmitting property of a second vibration of the intermediate transferring member, the first vibration being caused during the pressing and the second vibration being caused during the release; and the feed forward control may be designed in accordance with the first transmitting property.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

PREFERRED EMBODIMENT OF THE INVENTION

Hereinafter, the present invention will be explained with reference to the drawings. In the following description, the present invention will be explained by exemplifying a case that the present invention is applied to an image forming apparatus which can carry out a color print. However, the present invention is not limited to this.

Figure 1:
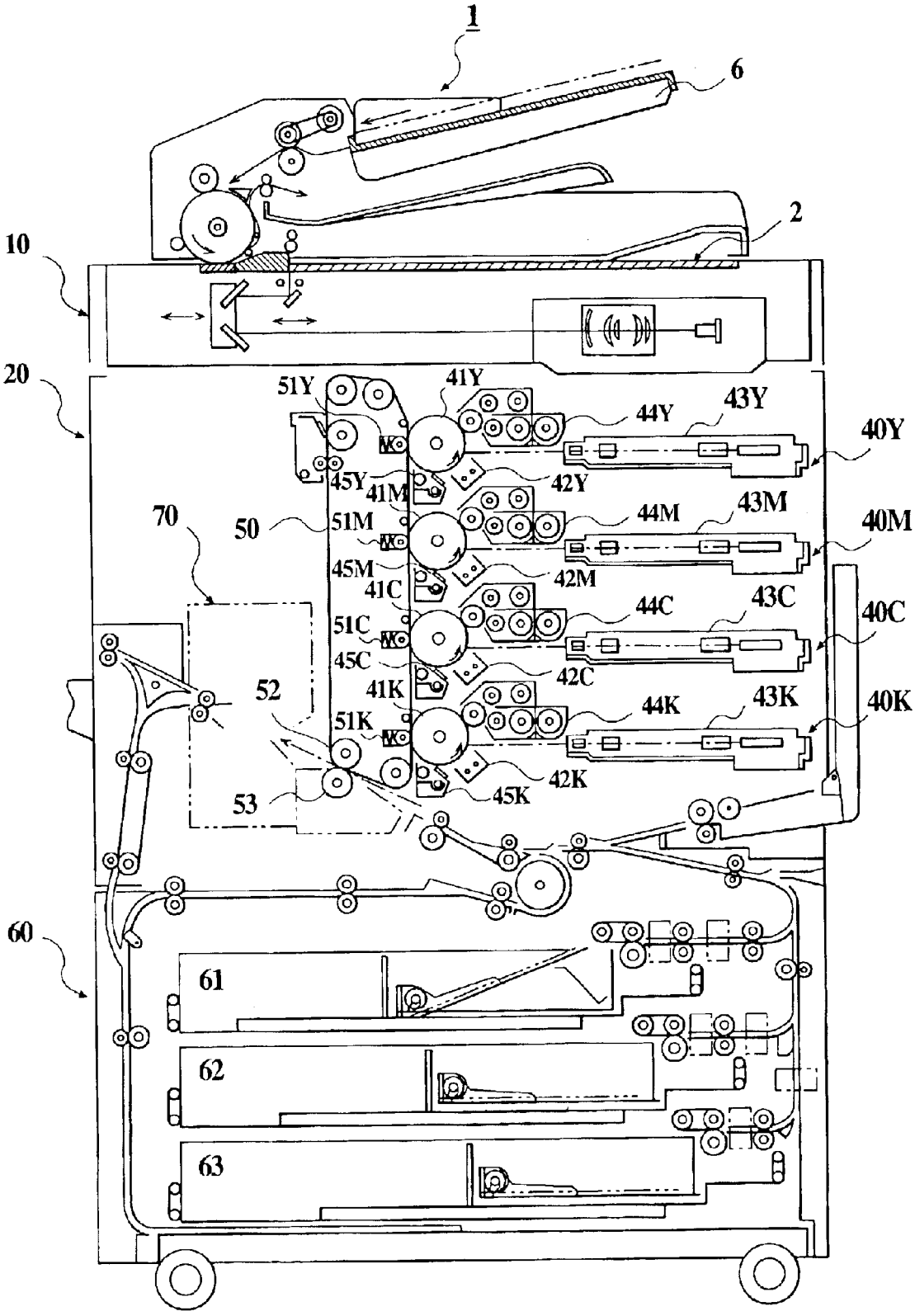
FIG. 1 is a view showing a schematic cross section of the image forming apparatus.

A whole structure of the image forming apparatus according to the present embodiment is explained with reference to the schematic cross sectional view of an image forming apparatus 1 shown in FIG. 1. As shown in FIG. 1, the image forming apparatus 1 comprises an image reading part 10 and an print part 20.

The image reading part 10 comprises a scanner having a light source, a lens, a CCD (Charge Coupled Device) and the like. The image reading part 10 reads a document image by focusing a reflected light of a light irradiating on a document to form an image and by carrying out a photoelectric conversion. Further, the image reading part 10 outputs the image to the print part 20. In this specification, the term "document image" has a meaning including not only an image data, such as a figure, a picture or the like, but also a text data, such as a character, a mark or the like.

The print part 20 comprises each image forming section 40Y, 40M, 40C and 40K, an intermediate transferring belt (intermediate transferring member) 50, a paper feeding section 60 and a fixing section 70.

The image forming section 40Y comprises a photosensitive drum 41Y which is a photosensitive member, a charging unit 42Y, an exposing unit 43Y, a develop unit 44Y and a cleaning unit 45Y, and forms a yellow image (Y). In the concrete, the charging unit 42Y charges a photosensitive surface of the photosensitive drum 41Y. The exposing unit 43Y forms an electrostatic latent image by irradiating a light on the charged photosensitive drum 41Y. The develop unit 44Y develops the electrostatic latent image by attracting a charged toner to the surface of the photosensitive drum 41Y on which the electrostatic latent image is formed. After the toner attracted to the surface of the photosensitive drum 41Y by the develop unit 44Y is transferred to an intermediate transferring belt 50 which will be explained below, the cleaning unit 45Y removes remaining charges, remaining toner and the like, which remain on the surface of the photosensitive drum 41Y.

Similarly, the image forming section 40M comprises a photosensitive drum 41M, a charging unit 42M, an exposing unit 43M, a develop unit 44M and a cleaning unit 45M, and forms a magenta image (M). The image forming section 40C comprises a photosensitive drum 41C, a charging unit 42C, an exposing unit 43C, a develop unit 44C and a cleaning unit 45C, and forms a cyan image (C). The image forming section 40K comprises a photosensitive drum 41K, a charging unit 42K, an exposing unit 43K, a develop unit 44K and a cleaning unit 45K, and forms a black image (K).

The intermediate transferring belt 50 is rotatably supported by a plurality of rollers and rotates in accordance with the rotation of each roller. The intermediate transferring belt 50 is pressed to the photosensitive drum 41Y by a press/ release roller 51Y. Similarly, the intermediate transferring belt 50 is pressed to the photosensitive drum 41M by a press/release roller 51M, is pressed to the photosensitive drum 41C by a press/release roller 51C and is pressed to the photosensitive drum 41K by a press/release roller 51K. Thereby, each toner for developing an image on each surface of the photosensitive drums 41Y, 41M, 41C and 41K, is transferred to the intermediate transferring belt 50 at each press position of the press/release roller 51Y, 51M, 51C and 51K. By rotating the intermediate transferring belt 50, each of yellow, magenta, cyan and black toners is transferred so as to overlap them in order.

The paper feeding section 60 feeds a recording paper set in paper trays 61, 62 and 63 to paper transferring rollers 52 and 53. A toner image transferred to the intermediate transferring belt 50 is transferred to a recording paper surface by the paper transferring rollers 52 and 53. The fixing section 70 carries out a heat fixture of the toner image transferred to the recording paper.

A user of the image forming apparatus 1 explained above uses a copy function by setting a document on a document handler 2 or on a document sending tray 6 and by starting the print (copy). Further, the image forming apparatus 1 may have a function of a printer for printing an image in accordance with an image data inputted from a terminal, such as an external personal computer, by connecting the image forming apparatus with the terminal.

Figure 2:
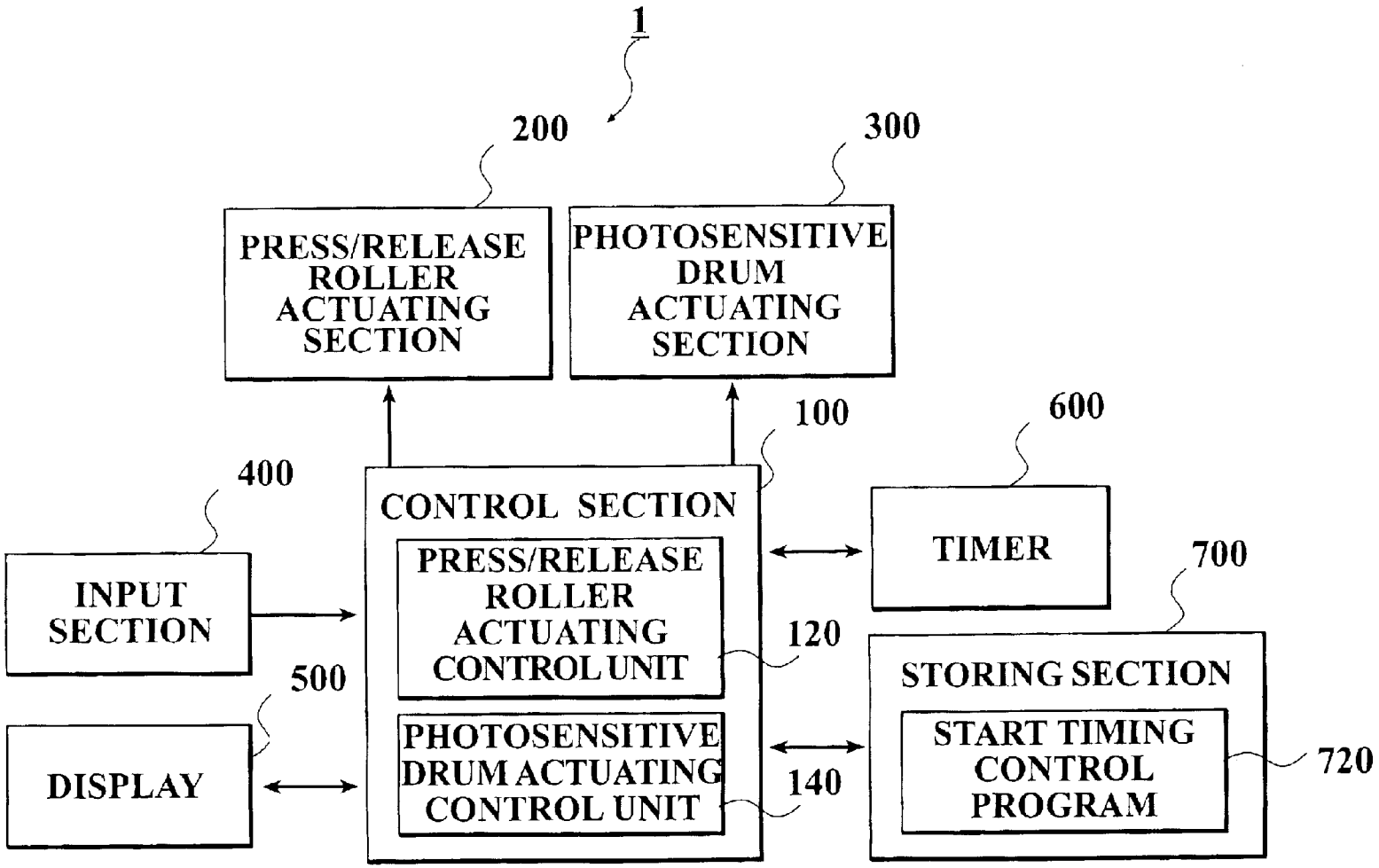
FIG. 2 is a view showing a functional structure of the image forming apparatus according to the present embodiment.

Next, the functional structure of the image forming apparatus 1 will be explained with reference to FIG. 2. In FIG. 2, the image forming apparatus 1 comprises a control section 100, a press/release roller actuating section 200, a photosensitive drum actuating section 300, an input section 400, a display 500, a timer 600 and a storing section 700.

The control section 100 comprises a CPU (Central Processing Unit) and the like, and expands a program and a data stored in the storing section 700, to a temporary storing area (not shown in the figure), such as a RAM, in accordance with a processing command inputted from the input section 400. The control section 100 carries out each process, such as the control of the whole image forming apparatus 1, the instruction for each section of the image forming apparatus 1, and the like, in accordance with the expanded program, to operate the image forming apparatus 1. In particular, in order to realize the present embodiment, the control section 100 comprises a press/release roller actuating control unit 120 for outputting an actuating signal to the press/release roller actuating section 200 to actuate (move) the press/release roller 51 (51Y, 51M, 51C and 51K) in a pressing direction or a releasing direction of the intermediate transferring belt 50, and a photosensitive drum actuating control unit 140 for outputting an actuating signal to the photosensitive drum actuating section 300 to control the rotational actuation of the photosensitive drum 41 (41Y, 41M, 41C and 41K) shown in FIG. 1. The press/release roller actuating control unit 120 and the photosensitive drum actuating control unit 140 will be explained below.

Figure 3:
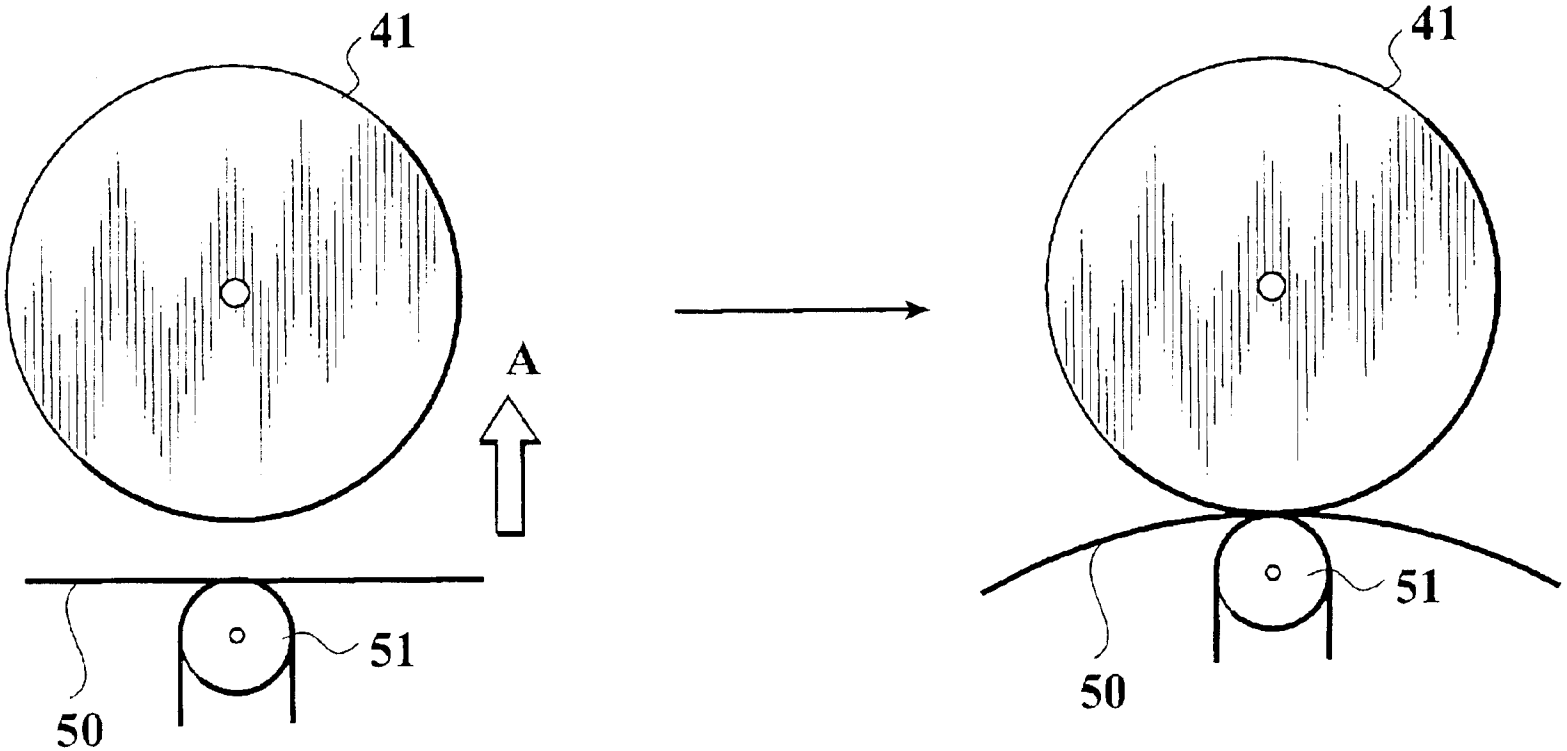
FIG. 3 is a view for explaining a pressing operation of the intermediate transferring belt to the photosensitive drum.

Firstly, the pressing operation for pressing the intermediate transferring belt 50 to the photosensitive drum 41 will be explained with reference to FIG. 3. As shown in FIG. 3, the press/release roller actuating control unit 120 controls the actuation of the press/release roller 51 to move the press/release roller 51 in the pressing direction A. Thereby, the intermediate transferring belt 50 is pressed to the photosensitive drum 41. Further, the press/release roller actuating control unit 120 controls the actuation of the press/release roller 51 to move the press/release roller 51 in an opposite direction of the pressing direction A, that is, the releasing direction. Thereby, the intermediate transferring belt 50 is released from the photosensitive drum 41.

Figure 4:
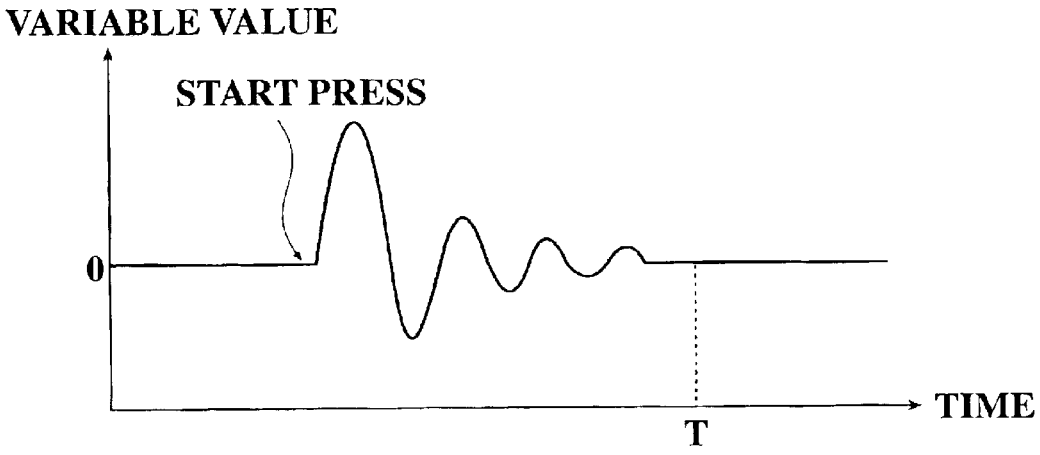
FIG. 4 is a view showing the amplitude of the vibration of the photosensitive drum, which is caused by pressing the intermediate transferring belt to the photosensitive drum.

Next, the amplitude of the vibration of the photosensitive drum 41, which is caused by pressing the intermediate transferring belt 50 to the photosensitive drum 41, will be explained as a function of a lapse of time with reference to FIG. 4. In FIG. 4, the abscissa axis expresses time which elapses after the print starting command is inputted, and the ordinate axis expresses the variable value of the vibration level, which varies as time elapses. In the embodiment, the condition that the vibration of the photosensitive drum, which is caused by the disturbance triggered by pressing the intermediate transferring belt 50, subsides is defined as the finish of the pressing operation. The elapsed time "T" which is expected to elapse until the pressing operation is finished, is assumed to previously set the required time "T" from the operation that the print starting command is inputted, to the condition that the pressing operation is finished. In the embodiment, because the experimental result that time which is required to finish the pressing operation is not longer than 100 msec. is obtained, the required time "T" maybe set to 100 msec. The control section 100 instructs the timer 600 to measure the elapsed time from the print starting command and judges the finish of the pressing operation in accordance with the information relating to the lapse of the required time "T" from the timer 600.

In the concrete, the control section 100 carries out the process in accordance with the start timing control program 720 stored in the storing section 700 and determines the timing for starting the control of the rotational actuation of the photosensitive drum 41. The photosensitive drum actuating control unit 140 starts the rotational actuating control for the photosensitive drum 41 in accordance with the determined start timing. In the embodiment, the photosensitive drum actuating control unit 140 carries out the rotational actuating control for the photosensitive drum 41 by using the feed back control (hereinafter, referred to as "FB control") in combination with the feed forward control (hereinafter, referred to as "FF control").

In general, the transmitting property of the vibration of the intermediate transferring belt 50, which is caused while the intermediate transferring belt 50 is pressed to the photosensitive drum 41, is different from the transmitting property of the vibration caused while the intermediate transferring belt 50 is released from the photosensitive drum 41. Therefore, when the FB control and the FF control are designed, the transmitting property of the vibration caused during the pressing and/or the transmitting property of the vibration caused during the release are considered. The concrete examples are explained in the examples 1 and 2.

The input section 400 comprises various types of key groups, such as cursor keys, ten keys, function keys and the like, to which each peculiar function is assigned, and outputs the pressing signal corresponding to the pressed key, to the control section 100. Further, for example, an indicating unit of the input section 400 may be realized by a touch panel which is provided so as to unify the display 500 with the input section 400. A desired key position of the display 50, which is indicated by a finger, a touch pen for the display 500 or the like is detected to output a signal to the control section 100.

The display 500 comprises an LCD (Liquid Crystal Display) and the like and displays each type of setting screen, such as a menu selecting screen, an image quality adjusting screen, a paper setting screen and the like, a confirmation screen, the condition of the image forming apparatus 1, an error message and the like. The control section 100 outputs a display signal corresponding to the display information, to the display 500, and displays the display information.

The timer 600 sets a timer value, and measures the elapsed time from the setting of the timer value is set. When the elapsed time reaches the timer value, the timer 600 informs the control section 100 of the lapse of the set timer value. By the timer 600, the elapsed time is measured since the print starting command is received.

In the storing section 700, an initial program for carrying out each type of initial setting, an inspection of the hardware, the load of a necessary program or the like, to set the operating environment of the image forming apparatus 1, is stored. Further, in the storing section 700, each type of processing program relating to the image forming, the data processed in accordance with the processing program, and the like are stored. In particular, in order to realize the present embodiment, the start timing control program 720 is stored.

Hereinafter, the control example of each start timing of the FB control and the FF control relating to the rotational actuation of the photosensitive drum 41 by the photosensitive drum actuating control unit 140 is explained.

EXAMPLE 1

Figure 5:
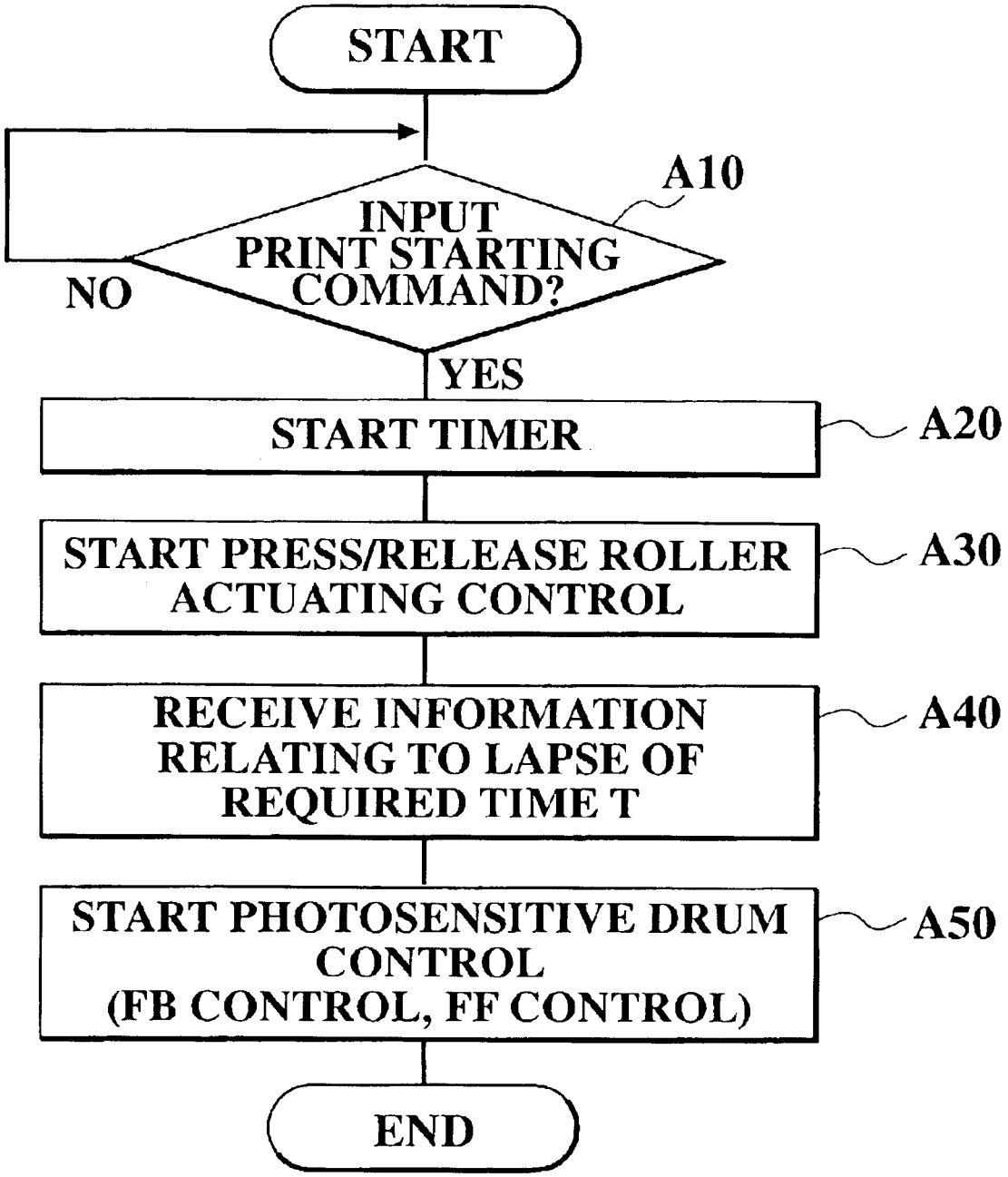
FIG. 5 is a flowchart for explaining the start timing control for starting the rotational actuating control for the photosensitive drum according to the example 1.

In case of the example 1, the FB control and the FF control relating to the rotational actuation of the photosensitive drum 41 are started when the pressing operation is finished. With reference to the flowchart shown in FIG. 5, the start timing control for starting the FB control and the FF control in the example 1 is explained.

In the example 1, the FB control and the FF control are designed in accordance with the transmitting property of the vibration of the intermediate transferring belt 50, which is caused while the intermediate transferring belt 50 is pressed to the photosensitive drum 41.

The control section 100 monitors the input of the print control command to be inputted from the input section 400 (Step A10). The control section 100 sets the required time "T" from the print starting command to the finish of the pressing operation, to the timer value in accordance with the print starting command. Then, the control section 100 starts the timer 600 (Step A20).

On the other hand, in a series of image forming process started in accordance with the print starting command, in particular, the press/release roller actuating control unit 120 starts the actuating control of the press/release roller 51 to output the corresponding actuating signal to the press/release roller 51 (Step A30). Then, the intermediate transferring belt 50 is pressed to the photosensitive drum 41.

When the information relating to the lapse of the required time "T" (timer value) is received from the timer 600 (Step A40), the photosensitive drum actuating control unit 140 starts the rotational actuating control for the photosensitive drum 41 in accordance with the FB control and the FF control to output the corresponding actuating signal to the photosensitive drum actuating section 300 (Step A50).

According to the example 1 explained above, when the pressing of the intermediate transferring belt 50 to the photosensitive drum 41 is finished, the photosensitive drum actuating control unit 140 starts the rotational actuating control for the photosensitive drum 41 by using the FB control and the FF control. Therefore, it is not required that the disturbance caused by pressing the intermediate transferring belt 50 is considered when the rotational actuating control for the photosensitive drum 41 is carried out. That is, because the rotational actuating control for the photosensitive drum 41 is started when the pressing operation is finished, it is possible to improve the stability of the control. In fact, during the pressing operation of the intermediate transferring belt 50 to the photosensitive drum 41, the process for forming an image is not carried out.

EXAMPLE 2

In case of the example 2, in the FB control and the FF control relating to the rotational actuation of the photosensitive drum 41, the FB control is started when the print starting command is inputted and the FF control is started when the pressing operation is finished.

Figure 6:
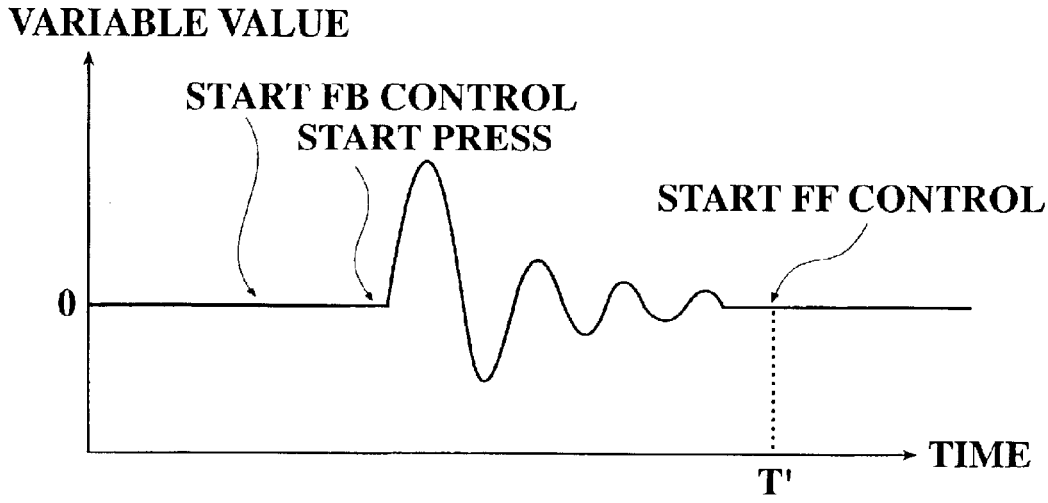
FIG. 6 is a view for explaining the start timing of the rotational actuating control for the photosensitive drum according to the Example 2.

That is, as shown in FIG. 6, the photosensitive drum actuating control unit 140 carries out the FB control for the rotational actuation of the photosensitive drum 41 in accordance with the print starting command. The control section 100 monitors the finish of the pressing operation in accordance with the information relating to the lapse of the required time "T'" from the timer 600. When the pressing operation is finished, the photosensitive drum actuating control unit 140 starts the FF control and controls the rotational actuation of the photosensitive drum 41 by using the FB control and the FF control.

In the example 2, the FB control is designed in accordance with the transmitting property of the vibration of the intermediate transferring belt 50, which is caused while the intermediate transferring belt 50 is pressed to the photosensitive drum 41, and the transmitting property of the vibration of the belt 50, which is caused while the intermediate transferring belt 50 is released from the photosensitive drum 41. The FF control is designed in accordance with the transmitting property of the vibration of the intermediate transferring belt 50, which is caused while the intermediate transferring belt 50 is pressed to the photosensitive drum 41.

In the example 2, because the FB control is carried out for the rotational actuation of the photosensitive drum 41 during the pressing operation of the intermediate transferring belt 50 to the photosensitive drum 41, the required time "T'" for finishing the pressing operation can be set more shortly than the required time "T" shown in FIG. 4.

Figure 7:
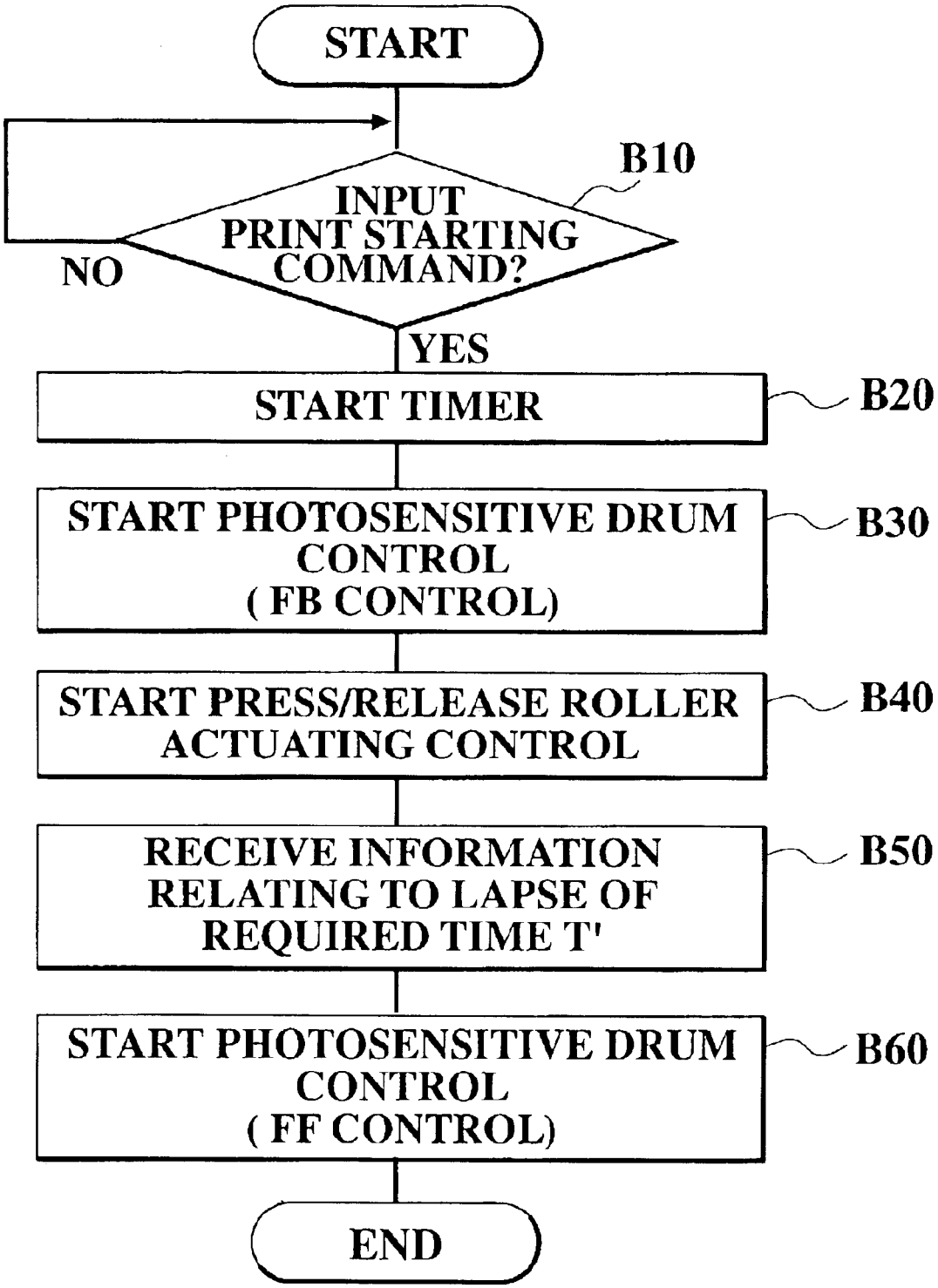
FIG. 7 is a flowchart for explaining the start timing control for starting the rotational actuating control for the photosensitive drum according to example 2.

With reference to the flowchart shown in FIG. 7, in case of the example 2, the control for each start timing of the FB control and the FF control is explained.

That is, the control section 100 monitors the input of the print control command to be inputted from the input section 400 (Step B10). The control section 100 sets the required time "T'" from the print starting command to the finish of the pressing operation, to the timer value in accordance with the print starting command. Then, the control section 100 starts the timer 600 (Step B20).

The photosensitive drum actuating control unit 140 starts the rotational actuating control for the photosensitive drum 41 in accordance with the FB control to output the corresponding actuating signal to the photosensitive drum actuating section 300 (Step B30).

On the other hand, in a series of image forming process started in accordance with the print starting command, in particular, the press/release roller actuating control unit 120 starts the actuating control of the press/release roller 51 to output the corresponding actuating signal to the press/release roller 51 (Step B40). Then, the intermediate transferring belt 50 is pressed to the photosensitive drum 41.

When the information relating to the lapse of the required time "T'" (timer value) is received from the timer 600 (Step B50), the photosensitive drum actuating control unit 140 starts the rotational actuating control for the photosensitive drum 41 in accordance with the FF control to output the corresponding actuating signal to the photosensitive drum actuating section 300 (Step B60).

According to the example 2 explained above, for example, when the print starting command is inputted, the photosensitive drum actuating control unit 140 starts the rotational actuating control for the photosensitive drum 41 in accordance with the FB control. After the finish of the pressing operation of the intermediate transferring belt 50 to the photosensitive drum 41, the rotational actuating control is carried out by using the FF control with the FB control. Therefore, the photosensitive drum actuating control unit 140 can carry out the feed back control for the rotational actuation in consideration of the vibration caused by pressing the intermediate transferring belt 50 to the photosensitive drum 41. According to this example, for example, it is possible to apply the apparatus 1 to the case that the required time for judging the finish of the pressing operation from the pressing of the intermediate transferring belt 50 is limited. Further, it is not required that the disturbance caused by pressing the intermediate transferring belt 50 should be considered when the photosensitive drum actuating control unit 140 carries out the rotational actuation control for the photosensitive drum 41 in accordance with the FF control.

The embodiment of the present invention is explained above. However, the present invention is not limited to the embodiment. The present invention may be suitably modified without departing from the gist thereof.

For example, when the intermediate transferring belt 50 is released from the photosensitive drum 41, the stop timing of the rotational speed control is controlled so as to stop the rotational actuating control of the photosensitive drum 41. In the concrete, for example, when the press/release roller actuating control unit 120 controls the press/release roller actuating section 200 so as to move the press/release roller 51 in a releasing direction, the photosensitive drum actuating control unit 140 stops the rotational actuation control for the corresponding photosensitive drum 41. Therefore, when the photosensitive drum 41 is rotationally actuated, it is not required that the vibration caused by releasing the intermediate transferring belt 50 from the photosensitive drum 41 is considered. Further, it is possible to improve the stability of the control.

Instead of the timer 600, the photosensitive drum 41 may comprises a sensor for detecting the vibration of the photosensitive drum 41. Thereby, in case that the actuating control for moving the press/release roller 51 in a pressing direction is started by the press/releasing roller actuating control unit 120, when the vibration of the photosensitive drum 41, which is detected by the sensor, subsides, the finish of the pressing operation may be judged.

The entire disclosure of Japanese Patent Application No. Tokugan 2002-140198 filed on May 15, 2002 including specification, claims drawings and summary are incorporated herein by reference in its entirety.

What is claimed is:

1. An image forming apparatus comprising:

a photosensitive member;

an intermediate transferring member to which an image formed on the photosensitive member is transferred;

a press/release operation controlling section for controlling a pressing of the intermediate transferring member to the photosensitive member and for controlling a release of the pressing;

a rotational actuation controlling section for controlling a rotational actuation of the photosensitive member;

a judging section for judging a finish of a pressing operation carried out by the press/release operation controlling section; and a start timing controlling section for starting a control for the rotational actuation of the photosensitive member by the rotational actuation controlling section when the judging section judges the finish of the pressing operation.

2. The apparatus of claim 1, further comprising: a time measuring section for measuring an elapsed time from a start of an image forming process;

wherein the judging section judges whether the pressing operation of the intermediate transferring member is finished in accordance with the elapsed time measured by the time measuring section.

3. The apparatus of claim 1, further comprising: a stop timing controlling section for stopping the control carried out by the rotational actuation controlling section, when a releasing operation of the intermediate transferring member is started by the press/release operation controlling section.

4. The apparatus of claim 1, wherein the rotational actuation controlling section controls the rotational actuation of the photosensitive member by using a feed back control and a feed forward control.

5. The apparatus of claim 4, wherein the feed back control and the feed forward control are designed in accordance with a transmitting property of a vibration of the intermediate transferring member, the vibration being caused during the pressing.

6. An image forming apparatus comprising:

a photosensitive member;

an intermediate transferring member to which an image formed on the photosensitive member is transferred;

a press/release operation controlling section for controlling a pressing of the intermediate transferring member to the photosensitive member and for controlling a release of the pressing;

a rotational actuation controlling section for controlling a rotational actuation of the photosensitive member;

a judging section for judging a finish of a pressing operation carried out by the press/release operation controlling section; and a start timing controlling section for starting a control for the rotational actuation of the photosensitive member by the rotational actuation controlling section;

wherein the rotational actuation controlling section controls the rotational actuation of the photosensitive member by using the feed back control and the feed forward control; and wherein the start timing controlling section starts the feed forward control when the judging section judges that the pressing operation is finished.

7. The apparatus of claim 6, further comprising: a time measuring section for measuring an elapsed time from a start of an image forming process;

wherein the judging section judges whether the pressing operation of the intermediate transferring member is finished in accordance with the elapsed time measured by the time measuring section.

8. The apparatus of claim 6, further comprising: a stop timing controlling section for stopping the control carried out by the rotational actuation controlling section, when a releasing operation of the intermediate transferring member is started by the press/release operation controlling section.

9. The apparatus of claim 6, wherein the feed back control is designed in accordance with a first transmitting property of a first vibration of the intermediate transferring member and a second transmitting property of a second vibration of the intermediate transferring member, the first vibration being caused during the pressing and the second vibration being caused during the release; and wherein the feed forward control is designed in accordance with the first transmitting property.

* * * * *